US007152895B1

(12) United States Patent
Jussila et al.

(10) Patent No.: US 7,152,895 B1
(45) Date of Patent: Dec. 26, 2006

(54) SYSTEM AND METHOD FOR CONTROLLING THE MOVEMENTS OF CONTAINER HANDLING DEVICE

(75) Inventors: Ovali Jussila, Hyvinkaa (FI); Jari Kaiturinmaki, Helsinki (FI)

(73) Assignee: KCI Konecranes Plc, Hyvinkaa (FI)

( * ) Notice: Subject to any disclaimer, the term of this patent is extended or adjusted under 35 U.S.C. 154(b) by 96 days.

(21) Appl. No.: 10/031,105

(22) PCT Filed: Jul. 13, 2000

(86) PCT No.: PCT/FI00/00643

§ 371 (c)(1),
(2), (4) Date: Apr. 8, 2002

(87) PCT Pub. No.: WO01/05696

PCT Pub. Date: Jan. 25, 2001

(30) Foreign Application Priority Data

Jul. 15, 1999 (FI) ..... 991609

(51) Int. Cl.
*B66C 1/66* (2006.01)

(52) U.S. Cl. ..... 294/81.53; 294/81.21

(58) Field of Classification Search ..... 294/81.21, 294/81.2, 81.1, 81.53
See application file for complete search history.

(56) References Cited

U.S. PATENT DOCUMENTS 3,514,146 A * 5/1970 Zweifel et al. ..... 294/81.21
3,536,350 A 10/1970 Backteman ..... 294/81.21
3,547,478 A * 12/1970 Jacques ..... 294/81.21
3,712,661 A * 1/1973 Strand ..... 294/81.53
3,767,250 A * 10/1973 Ward ..... 294/81.21
3,789,998 A * 2/1974 Fathauer ..... 294/81.21
3,944,272 A * 3/1976 Fathauer ..... 294/81.21
4,215,892 A * 8/1980 Holmes ..... 294/81.21
4,418,953 A * 12/1983 Dunbar ..... 294/81.21
4,488,749 A * 12/1984 Voelz ..... 294/81.21
4,630,855 A 12/1986 Bjurling ..... 294/81.1
4,688,839 A * 8/1987 Hatley ..... 294/81.21
5,354,112 A * 10/1994 Hara et al. ..... 294/81.41
6,502,879 B1 * 1/2003 Miyazawa ..... 294/81.21

FOREIGN PATENT DOCUMENTS

EP 0365086 * 4/1990 ..... 294/81.21
GB 2031841 * 4/1980 ..... 294/81.21
JP 405246680 * 9/1993 ..... 294/81.2
SU 1730000 * 4/1992 ..... 294/81.53
SU 001730000 * 4/1992 ..... 294/81.21

* cited by examiner

*Primary Examiner*—Kathy Matecki
*Assistant Examiner*—Paul T. Chin
(74) *Attorney, Agent, or Firm*—Hoffmann & Baron, LLP

(57) ABSTRACT

A system and method for controlling the telescopic movements of two telescopic beams moving inside a spreader frame, and the locking movements of the twistlocks in the telescopic beams. The telescopic movement of the telescopic beams are held in position at a desired place in relation to the frame with locking members. The system has a joint multi-rope lever system for performing the telescopic movement of the telescopic beams and the locking movements of the twistlocks. The system has an actuator operating the multi-rope lever system. The system also includes a control system supervising and controlling the actuator and the lever system.

3 Claims, 4 Drawing Sheets

SYSTEM AND METHOD FOR CONTROLLING THE MOVEMENTS OF CONTAINER HANDLING DEVICE

FIELD OF THE INVENTION

The invention relates to a system for controlling the telescopic movements of telescopic beams in a spreader, and the locking movements of twistlocks in telescopic beams.

The invention also relates to a method for controlling the telescopic movements of telescopic beams in a spreader, and the locking movements of twistlocks in telescopic beams.

BACKGROUND OF THE INVENTION

A special spreader especially designed for the purpose is used for lifting containers. The spreader comprises a frame and two telescopic beams resting on the frame, the beams performing a telescopic movement, i.e. more exactly, a transfer movement in the direction of the longitudinal axis of the telescopic beams into and out of the spreader frame. Both the telescopic beams generally have two twistlocks. The telescopic beams grip the lifting attachments in the corners of the container with the twistlocks. As there are containers of several different lengths, i.e. the length may vary from 20 feet to 45 feet and even over that, a general-purpose spreader has to have a telescopic movement suitable for each length.

Spreaders are used with various forklifts and rope cranes movable on wheels. In rope cranes, the required energy is fed to the spreader with an electric cable, the spreader being provided with actuators for the necessary movements. The status information of the proximity switches used as accessories for the control system and the control commands from the control system usually travel along the same cable between the spreader and the rope crane.

The operating system for spreaders has traditionally been electro-hydraulic, because the telescopic movements needed in spreaders generally are long linear movements Hydraulic motors have been used as actuators in spreaders for generating a rotating movement, and hydraulic cylinders or chains have been used for generating a linear movement. A hydraulic aggregate and the actuators connected to the hydraulic aggregate require a lot of power because of their efficiency. The sliding surfaces of the telescopic parts in spreaders also require a lot of power for overcoming friction. Further, the hydraulic drive of spreaders usually contains several components, because several movements are needed in the spreaders. Such movements comprise the telescopic movement of the spreaders to the positions of 20', 40' and 45', the turning of four twistlocks, and the use of so-called flippers. The flippers are used for transferring the spreader to the right place above the container.

The spreaders have also been problematic because of several damages and oil leaks soiling harbour terminals. In use, also relatively hard impact stresses are often directed to the spreader, stopping the operation of the spreader for the time of service or repair or possible for the time the entire device is changed. Sea climate again causes fast corrosion damages especially to surfaces, from which use takes away the protective layer of paint, thus causing the spreader to be serviced at more frequent intervals. Such services comprise, for example, the sliding surfaces between the spreader frame and the telescopic beams.

The present spreaders, with which it is possible to grip containers of different lengths by using the telescopic movement of the spreaders, are also relatively heavy in comparison with the load to be lifted, their unloaded weight being about 27%, on average, of the maximum load. A spreader with a large unloaded weight requires a considerable amount of driving energy, which again requires that the lifting gear of the cranes be dimensioned larger.

SUMMARY OF THE INVENTION

The object of the present invention is to provide a spreader, which does not contain the drawbacks present in the state-of-the-art technology.

Thus, the principal object of the invention is to provide a spreader with a reduced need for driving energy. More specifically, the need for driving energy of the spreader will be decreased without reducing the operational reliability or industrial safety of the spreader, but the unloaded weight of the spreader compared with the maximum load will be clearly reduced in comparison with the known spreaders.

The second principal object of the invention is to provide a spreader, in which it has been tried to minimize the effects of external impacts damaging the spreader. More specifically, the object of the invention is to develop the structure of the spreader so that impact stresses may be received with sufficient elasticity in all directions without exceeding the yield limit or fatigue strength of the material at any place.

It is further an object of the invention to provide a spreader with a considerably decreased need for service.

The basic idea of the spreader of the invention is that the telescopic movements of the telescopic beams of the spreader and the locking movements of the twistlocks are controlled with the same multi-rope lever system, in which each operation of the spreader is represented by a different rope force in the multi-rope system.

The locking movements of the twistlocks here refer both to the opening and locking movements of the twistlocks.

More specifically, the invention relates to a system for controlling the telescopic movements of the telescopic beams in the spreader and the locking movements of the twistlocks in the telescopic beams.

The invention also relates to a method for controlling the telescopic movements of the telescopic beams in the spreader and the locking movements of the twistlocks in the telescopic beams.

In the system of the invention, the spreader includes two telescopic beams, which move inside the spreader frame. The system comprises a joint multi-rope lever system for performing the locking movements of the telescopic beams and the twistlocks, at least one actuator driving the multi-rope lever system, and a control system supervising and controlling the operations of both the actuator and the lever system. In addition, the telescopic beams and the frame of the spreader include locking members for stopping the telescopic movement of the telescopic beams to a desired point in relation to the frame.

It is characteristic of the method of the invention that as one wants to move the telescopic beams telescopically outwards or inwards in relation to the frame of the spreader, the first locking member between both the telescopic beams and the frame of the spreader is first opened, the first locking member comprising the locking unit for the frame and the first locking point for the telescopic beam, and a rope force is generated to the multi-rope lever system for the telescopic beams in the spreader for transferring the telescopic beams in relation to the frame of the spreader, as the second locking points in the telescopic beams meet the locking unit of the frame in the spreader, the multi-rope lever system is provided with the second rope force different from the first rope force, so that the second locking points of the telescopic beams may be transferred into the locking units of the frame with the said second rope force, as the second locking member with the second locking point for the telescopic beam and the locking unit of the frame of the spreader is locked, the third rope force is generated to the lever system for opening and/or closing the twistlocks of the telescopic beams.

The locking members of the spreader preferably comprise locking points in the telescopic beams, the locking units in the frame of the spreader being equivalent to the said locking points.

For performing the telescopic movements of the telescopic beams and the various locking movements of the twistlocks, the actuator has to generate force levels of different sizes to the rope system. If a rope force of, for example, 1 kN, had to be generated to the multi-rope lever system in the transfer movement between two locking points of the telescopic beam, a rope force sufficient for transferring the locking unit of the telescopic beam to the locking point would be approx. 2 kN. In this case, a rope force of 10 kN would be equivalent to the locking of the locking member (because the actuator is not used for forced opening of the locking, this mainly refers to the rope force with which the lever system still may be loaded without opening the locking). For opening the twistlock, the rope force could be, for example, 3.5–6 kN.

With the above control system, in which the rope forces for driving the lever system in each driving mode, i.e. in each operation conducted by the multi-rope lever system, are chosen clearly different, it is possible to reliably control the spring system formed by the several ropes in the lever system. In this case the advantage is achieved that it is possible to perform both the telescopic movement of the telescopic beams and the opening and closing of the twistlocks with the same multi-rope lever system.

In the control method of the invention, it is possible to control the operation of the multi-rope lever system with the help of the control logic and the frequency converter of the control system, as the rope forces are chosen clearly different in the different driving modes.

The multi-rope lever system used in the control system of the invention is preferably common to both the telescopic beams of the spreader, and the multi-rope lever system is operated by one actuator. The actuator may, for example, be an electric motor.

By using the multi-rope lever system for performing the telescopic movements of the spreader and the locking movements of the twistlocks, and by operating the lever system by an electric motor, a considerable saving in energy costs is achieved, because the unloaded weight of the spreader compared with the maximum load is reduced by almost a half in comparison with the known systems, in which hydraulic aggregates are used combined with hydraulic motors and hydraulic cylinders or chains.

The serviceability of the control system of the invention has been improved so that the operation of the multi-rope lever system is controlled with the help of the control logic and frequency converter of the control system, and that deviations in rope forces are calculated and reported on the basis of the rope forces observed in the lever system and the target values for the rope forces. Thus, it is possible to locate the faults in the lever system, so that it is considerably easier to service the rope system.

For reducing the rolling resistance caused by the telescopic movement of the telescopic beams, support rollers and support springs affecting the support rollers are fastened to the frame of the spreader below each of the telescopic beams, the joint spring force of the support rollers and support springs being about equal to the gravity of the telescopic beam they support. With this system it is achieved that the energy demand for performing the telescopic movements of the telescopic beams in the spreader is further reduced as the telescopic beams move lightly inside the frame with the help of the support rollers.

As the supporting arms roll easily on the support rollers, the wear of the frame surfaces is considerably reduced, compared with a situation in which the telescopic beams would be moved by sliding against the sliding surfaces of the frame. Because the joint spring force of the support springs is about equal to the gravity of the telescopic beam they support, the telescopic beams are pressed against the support surface of the frame, as the telescopic beams carry a load, which further prevents the frame surfaces from wearing. Because of the way the telescopic beams move and because of the suspension, the considerable advantage is achieved that the need for service of the spreader is considerably reduced.

In an advantageous embodiment of the invention the controlling system for the control system sees to it that the twistlocks are not opened or closed before the locking units of the frame of the spreader have been locked into the locking points in the telescopic beams. For opening and closing the twistlocks, the actuator has to generate a smaller rope force to the rope system than the force which is required for forced opening of the locking between the locking unit and the locking point. The twistlocks of the telescopic beams are provided with forced springs. These structural solutions achieve the advantage that the rotation of the twistlocks is as safe as possible.

As the telescopic beams used in the spreader of the invention are hit by an external impact in the direction of the longitudinal axis of the telescopic beams, causing the telescopic beams to transfer from the first position in the direction of the longitudinal axis of the telescopic beams in relation to the frame to the second position in the direction of the longitudinal axis of the telescopic beams in relation to the frame, the elastic strain accumulated to the lever system returns the telescopic beams to their former position together with the shape of the form-locking groove in the locking member. Thus the considerably big advantage may be achieved that the system of the invention endures and suppresses well impacts directed to the spreader.

In the control system of the invention, the positions of containers of various sizes are clearly marked to the telescopic beams by locking points, which include a rise, i.e. a driving ramp, and a form-locking groove. The locking unit provided with a locking spring and a magnet adjusting the operation of the spring in the frame of the spreader is equivalent to the locking points. With the locking members of the invention the advantage is achieved that the impact-like loads may be restricted to the desired size by changing the shape of the form-locking groove or the spring force of the locking spring in the locking unit.

It may be noted of the further advantages to be achieved with the control system of the invention that:

properties of a commercial frequency converter may be utilised in the invention, the properties being equal to and partly better than in an electro-hydraulic drive. For example, the measuring of the torque of the actuator gives a chance to preventative maintenance;

due to the multi-rope lever system common to the telescopic beams, the inclined telescopic beams of the spreader operate as counter weights for each other.

The state of the art is represented by U.S. Pat. No. 3,536,350, which discloses a spreader, the recognition of the container position and the transfer movement of the telescopic beams into and out of the frame of which has been improved. However, this patent publication does not disclose the central features of the control system for the telescopic movements of the telescopic beams of the spreader of the invention or for the locking movements of the twistlocks of the telescopic beams.

The invention is next described in more detail, referring to the enclosed drawings.

DETAILED DESCRIPTION OF THE PREFERRED EMBODIMENTS

The movements of the flippers have been realized with separate gear motor drives. The more exact structural principle of the twistlocks and flippers is not shown in more detail, because their structure is similar to the one generally used in spreaders.

Figure 1A:
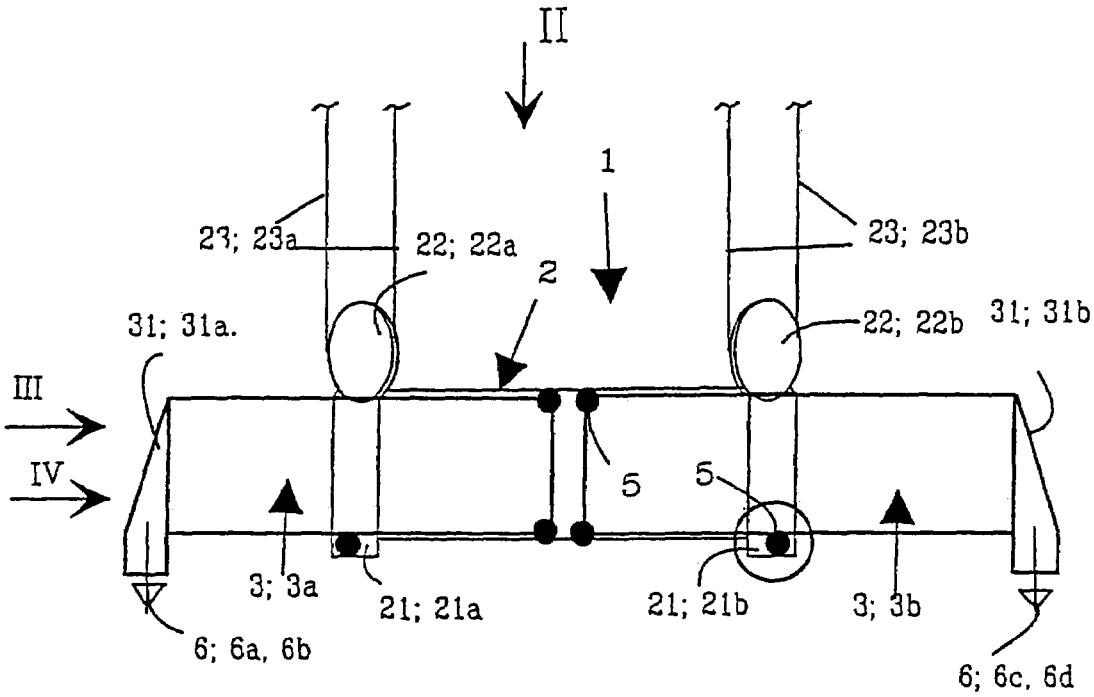
FIG. 1A is a schematic basic view of the spreader seen from the side.

FIG. 1A shows the main parts of the spreader from the side. The spreader comprises the frame 2 with telescopic beams 3 moving telescopically inside. The ends of the telescopic beams are provided with twistlocks 6.

Figure 1B:
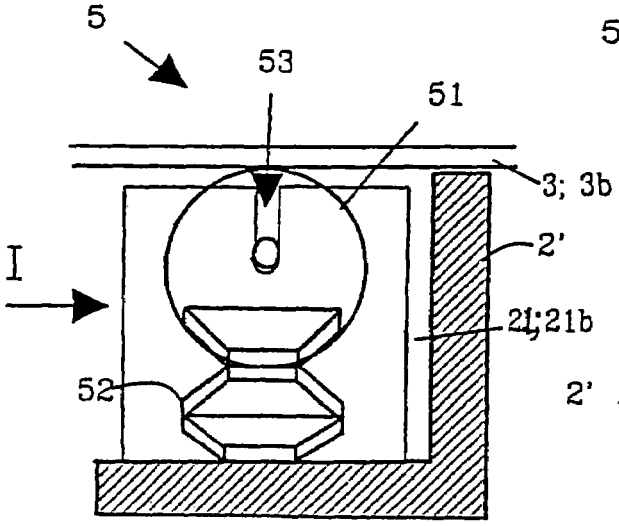
FIG. 1 B is a schematic basic view of the detail encircled in FIG. 1 A, enlarged and seen from the side.
FIG. 1C shows the detail 1B of FIG. 1A seen from the front, i.e. the direction I in FIG. 1B.
FIG. 1D is a top view and a schematic basic view of the spreader in FIG. 1A, i.e. seen from the direction II in FIG. 1.
Figure 1C:
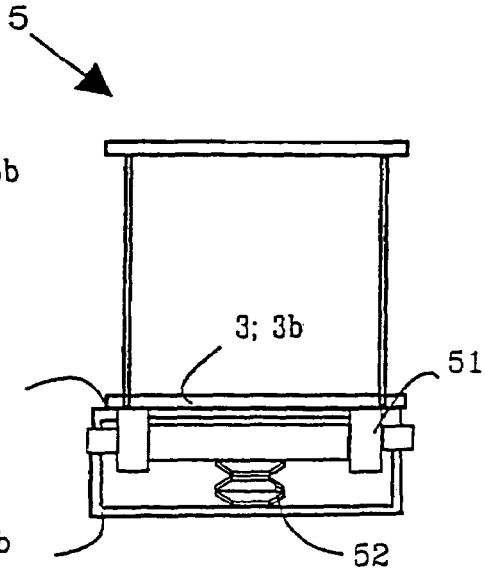

In FIGS. 1B and 1C, the detail encircled in FIG. 1 is shown enlarged and seen slightly from different directions. In FIG. 1B, the detail in question is shown from the same direction as in FIG. 1A; in FIG. 1C, this detail again is shown from the direction I in FIG. 1B. The detail shows the structure of the movement support 5 of the telescopic beam attached to the corner 21; 21*a* of the second frame.

Figure 1D:
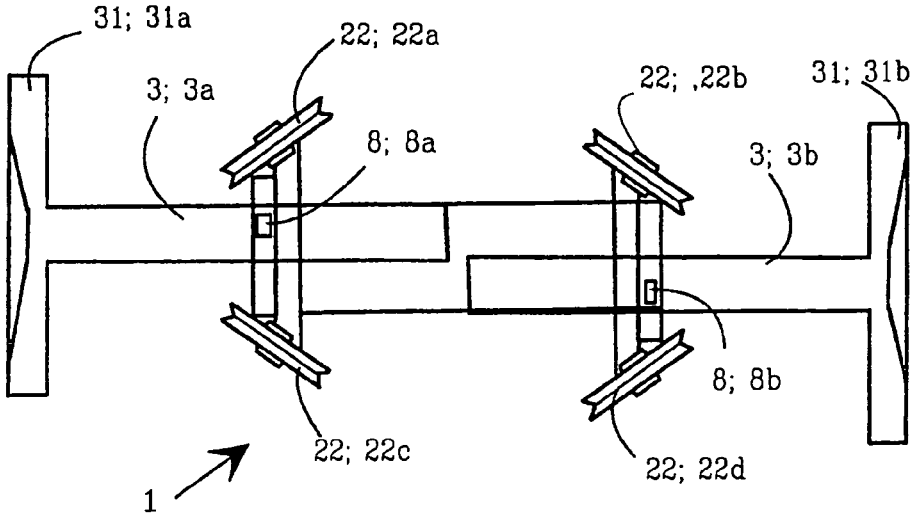

FIG. 1D shows in a more exact manner the way the telescopic beams 3 are placed in the frame 2. The figure also shows the rope pulleys 22; 22*a*, 22*b*, 22*c*, 22*d* used for lifting the frame.

Figure 2:
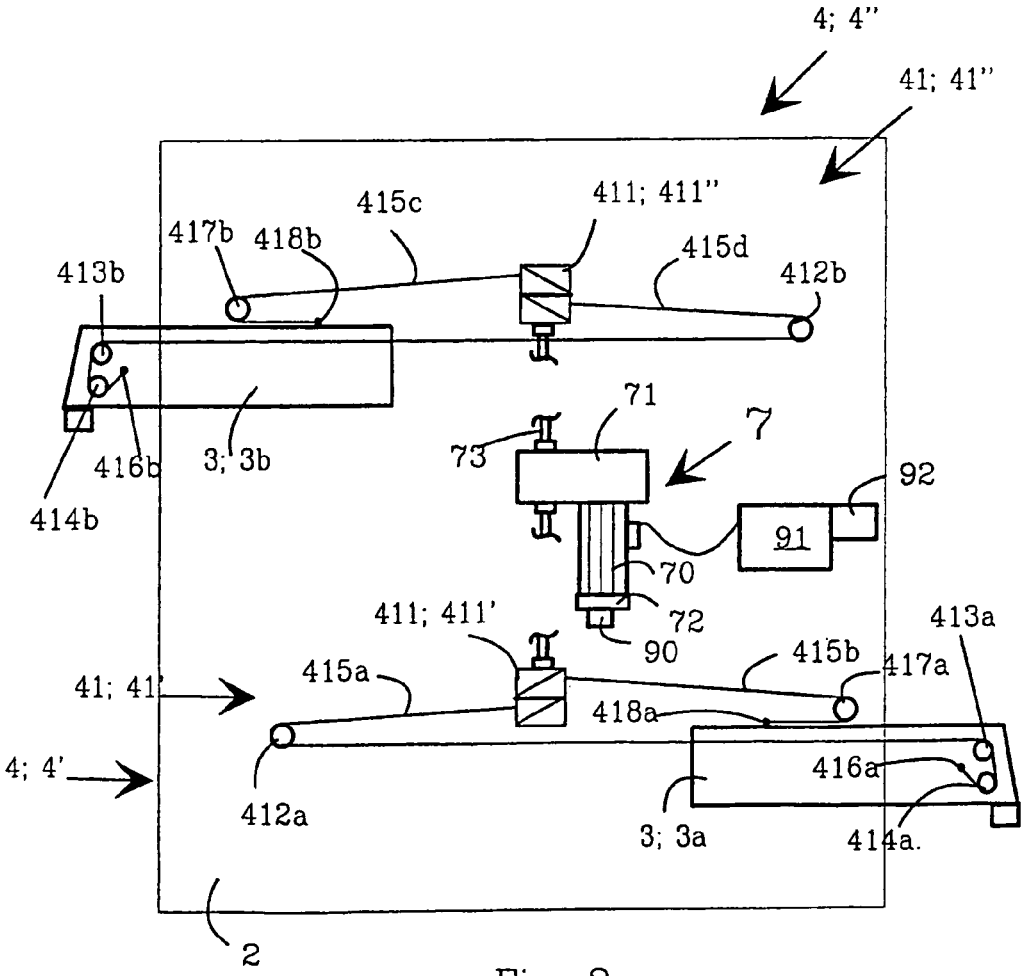
FIG. 2 is a schematic view of the rope pulleys in the lever system of the spreader of the invention.

In FIG. 2, there is shown the diagram of the principle of the structure of the rope pulleys 41 used in the invention for transferring the telescopic beams 3 of the lever system 4. The lever system 4 comprises two identical rope pulleys 41; 41' and 41". The rope pulleys 41' and 41" facing both the telescopic beams of the lever system is operated by the common actuator 7.

Figure 3A:
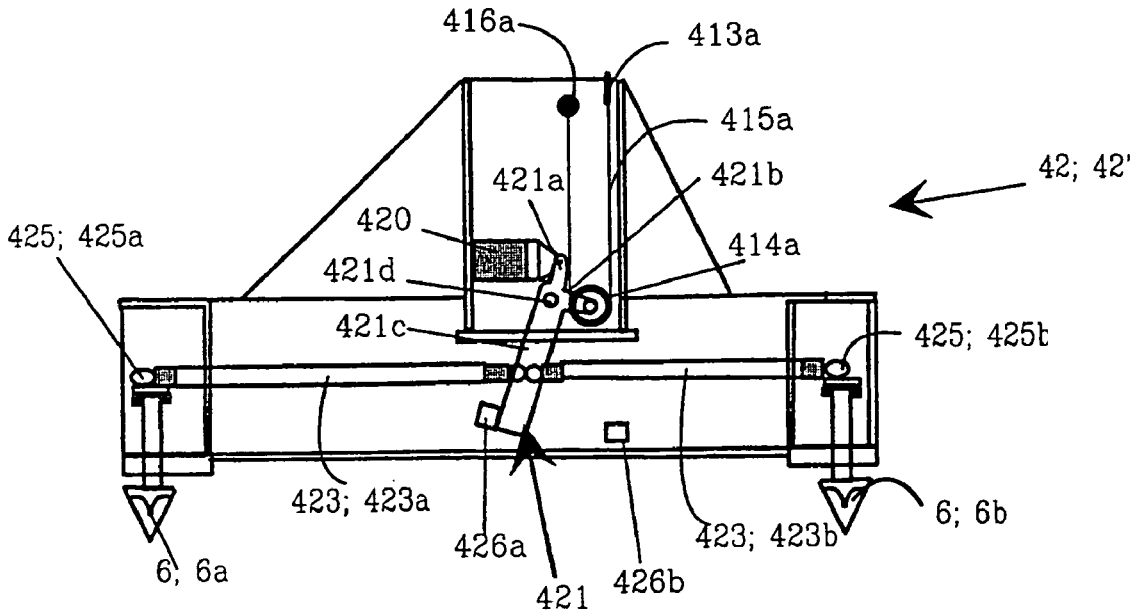
FIG. 3A shows the twistlock at the end of the telescopic beam and the rope leverage of the lever system used for controlling it, seen from the direction III in FIG. 1.
Figure 3B:
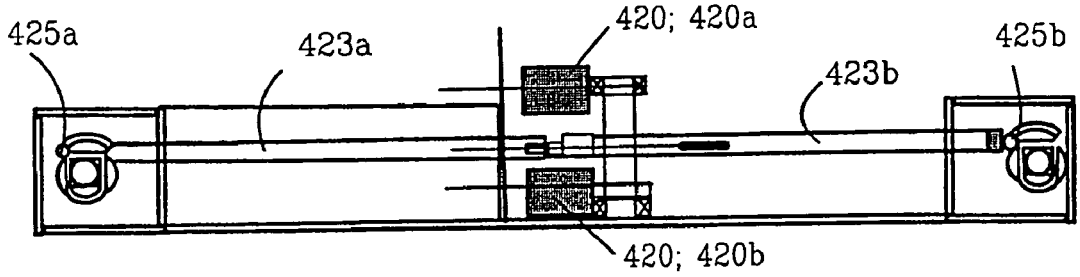
FIG. 3B is a top view of the twistlock and rope leverage of FIG. 3.

FIGS. 3A and 3B show the effect the rope pulleys 41 affecting the telescopic beams 3; 3*a*, 3*b* described in FIG. 2 have on the rope leverages 42 of the lever system 4 operating the twistlocks 6.

Figure 4A:
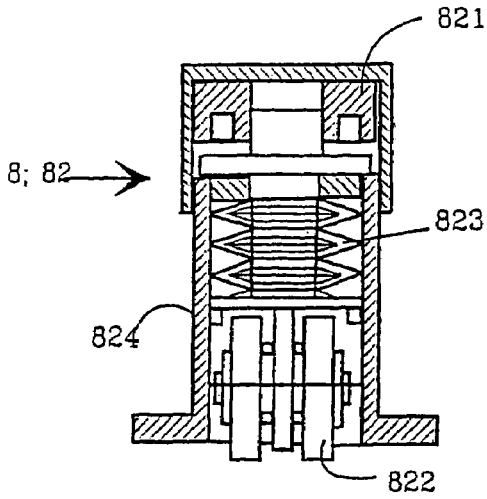
FIG. 4A shows the structure of the locking unit from the front, i.e. from the direction IV in FIG. 1.
Figure 4B:
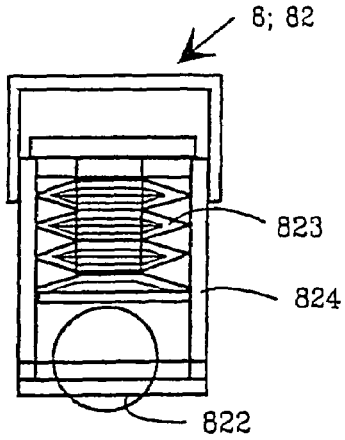
FIG. 4B shows the structure of the locking unit seen from the side.
Figure 4C:
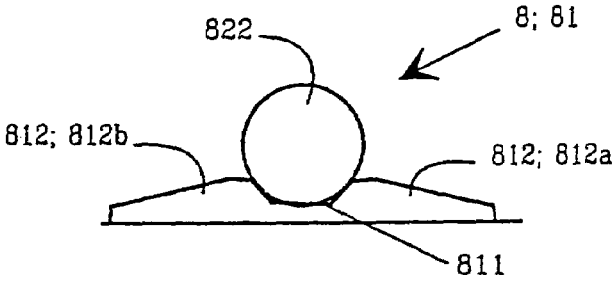
FIG. 4C shows the structure of the locking point seen from the side.

FIGS. 4A, 4B and 4C show the structure of the locking members 8 used for locking the telescopic beams. The locking members include the locking point 81, located on the upper surface of the telescopic beams 3, and the respective locking unit 82 at the place of the telescopic beams in the frame 2 so that when moving the telescopic beam in the direction of the longitudinal axis into or out of the frame, the locking unit hits the locking points on the upper surface of the telescopic beams.

Figure 5:
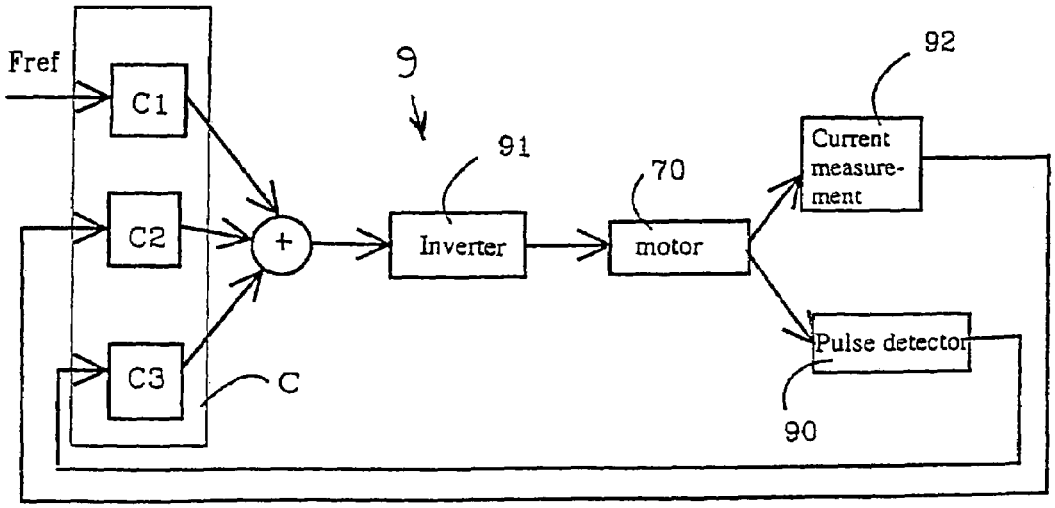
FIG. 5 is a schematic view of the control logic of the control system.

In FIG. 5, there is shown the control system 9 for controlling the lever system of the spreader. The physical placement of the parts in the control system into the structure of the spreader is apparent from FIG. 2.

FIG. 1A shows the frame 2 forming the load-bearing structure of the spreader 1, with telescopic beams 3; 3*a*, 3*b* installed in the frame. Seen from the centre of the spreader frame, the outer ends of the telescopic beams have the ends 31; 31*a*, 31*b*. Inside both the ends there are two twistlocks 6, which are used for gripping the corners of a container. Inside the end 31*a* of the telescopic beam, there are twistlocks 6; 6*a*, 6*b*, and inside the face 31*b* of the telescopic beam, there are twistlocks 6; 6*c*, 6*d*. Rope pulleys 22; 22*a*, 22*b*, 22*c*, 22*d* for lifting the frame are attached to the outer corners 21; 21*a*, 21*b* of the frame. Only the rope pulleys 22*a* and 22*b* are seen in the figure. The upper end of the rope 23 driving the rope pulleys is fastened to the crane, which is not shown in closer detail here.

The movement support 5 shown in FIGS. 1B and 1C comprises the support roller 51 and the spring 52. The springs 52 for the movement supports below each of the telescopic beams are dimensioned to bear only the weight of the telescopic beam 3; 3*a* or 3; 3*b* above. The movement support 5 is attached to the corner 21*a* of the frame from the support point. The support roller is able to perform a vertical movement in the controlled guide 53. The telescopic beams are supported on the movement supports 5, as the beam is transferred to a new position. The movement supports include the support rollers 51 provided with springs, which compress when the container is lifted. In this case, the container mainly burdens the support surface 2' in the frame. The material for the support roller 51 is chosen to have a small modulus of elasticity so that the surface pressure against the paint surface of the telescopic beam 3 would be very low and the paint would endure use for a long time. By using movement supports with support rollers, the resistance to motion and wear of the telescopic beams is reduced during the transfer movement. The solution saves the dimensional power of the equipment.

The actuator 7 operating the hoist blocks in FIG. 2 includes the motor 70, the gearing 71, and the brake 72. The force of the actuator 7 is transferred to the rope pulleys 41; 41', 41" of the lever systems 4; 4', 4" through the drive shaft 73 connected to the actuator.

The rope pulleys 41', 41" are connected to the drive shaft 73 of the actuator with the rope drums 411, 411', 411*b*", which thus operate resting on the bearing of the secondary gear (=drive shaft 73) of the gearing 71. The ropes 415*a*, 415*b* and 415*c* and 415*d* begin from the rope drums 411. The ropes 415*a* and 415*b* start from above the rope drum 411', and the ropes 415*c* and 415*d* from below the rope drum 411", respectively.

The rope 415*a* travels via the rope pulley 412*a* attached fast to the frame 2 to the pulleys 413*a* and 414*a* through the telescopic beam 3; 3*a*. The end of the rope is attached to the point 416*a* of the telescopic beam 3*a*. A two-rope tackle block is here formed with the help of the pulley 414*a*. The number of ropes in the tackle block may be varied according to the desired force.

The rope 415*b* travels through the rope pulley 417*a* attached to the frame 2 of the spreader, fastening to the point 418*a* of the telescopic beam 3*a*. The fastening of the ropes 415*b* and 415*d* to the telescopic beam 3, 3*b* by using the parts 412*b*, 413*b*, 414*b*, 416*b*, 417*b*, and 418*b* of the rope pulley 41" is identical with the arrangement of the rope pulley 41' of the telescopic beam 3; 3*a*. The frequency converter used for driving the motor and its connection is not described in more detail in this connection.

FIGS. 3A and 3B show the effect of the rope pulley 41' of the telescopic beam 3*a* on the twistlocks 6; 6*a*, 6*b* in the telescopic beam 3; 4*a* via the rope leverage 42'. The rope leverage 42" for the lever system 4" of the second telescopic beam 3*b* is similar to the rope leverage 42' for the lever system 4' of the telescopic beam 3*a* in the figure.

The rope pulley 41' moving the telescopic beam 3*a* affects the springs 420; 42C, 420*b* via the lever 421. The lever has three lever arms 421*a*, 421*b* and 421*c* which rotate round the bearing 421*d*. The springs 420*a* and 420*b* affect the lever arm 421*a*, the rope pulley 414*a* affects the lever 421*b*, and the transferring arms 423*a* and 423*b* affect the lever arm 421*c*. The transferring arms 423; 423*a*, 423*b*, of which the one pulls and the other pushes the levers 425*a* and 425*b*, are used for causing a rotating movement to the twistlocks 6; 6*a* and 6; 6*b*. The travel stop 426; 426*b*, 426*b* defines the area of movement for the lever 421, as the twistlock rotates 90 degrees. The proximity switches related with the travel stop 426 are not shown separately, as their operation and structure are conventional. As mentioned above, both the telescopic beams 3; 3*a*, 3*b* have a respective arrangement for the rope leverage 42; 42', 42" operating the twistlocks.

FIGS. 4A, 4B and 4C show the structure of the locking members. As many locking points 8; 81 are attached to the upper surface of the telescopic beams 3, as there are containers of different sizes. Each locking unit 8; 82 of the frame again includes the locking roller 822 and the electrical magnet 821, with which the locking force caused by the locking spring 823 is reversed. The parts 822, 823 and 824 of the locking unit 82 attach to the equipment frame 824 of the locking unit, the said equipment frame again being fastened to the frame 2, at the place of the telescopic beam 3.

The locking point 81 again includes a form-locking groove 811 and the driving ramps 812; 812*a*, 812*b* leading to this groove. The angles of inclination for the driving ramps are determined so that the extent of the force directed to the locking roller 822 indicates the location of the locking roller in relation to the form-locking groove to the logic. The travelling range of the locking spring 823 is restricted so that in the area between the locking units 82, the locking roller is situated clearly free from the upper surface of the telescopic beam.

The control logic circuit C for the control system 9 shown in FIG. 5 includes a speed controller, which defines the required driving speed according to the driving mode chosen. The rough determination of location is calculated in the logic C3 with the pulse detector 90. The force directed to the rope is determined from the inverter current 92 in the logic C2. A weighing detector may as well be used for measuring the force, because the control system described later does not set any restrictions regarding the choice of the actuator. The magnitudes of the rope forces occurring in the driving mode may be taught to the logic.

The control of the multi-rope lever system of the invention is next described in the driving mode A, in which the telescopic beams 3 are driven to a new position, for example, inwards. The logic C opens the brake 72 and releases the locking rollers 822 of the locking units 82 of both the telescopic beams from the form-locking groove 811 by lifting the locking rollers upwards with the help of the electrical magnets 821. The motor 70 is started, after which the locking rollers 822 are returned back down after about 2 seconds. The ropes 415*a* and 415*d* of the rope pulleys 41 in the rope leverage 4 tighten as they are reeled to the rope drums 411' and 411". Simultaneously, the ropes 415*b* and 415*c* are released from the rope drums 411' and 411", making it possible for the telescopic beams 3; 3*a* and 3; 3*b* to move into the frame 2. The telescopic beams move with a small resistance to motion on the support rollers 51 of the movement supports. The springs 420 of the lever systems 42 operating the twistlocks are chosen so that the precompression force of the springs is not exceeded, although the rope pulley tends to rotate the levers 421 affecting the springs in both the telescopic beams. At this stage, a rope force of approx. 1 kN has to be generated to the rope system of the motor 70 for moving the telescopic beams inwards. The rope force in question is seen as torque on the motor shaft 73.

The frequency converter 91 (inverter) controlled by the logic C accelerates the actuator to the field weakening area of the motor 70, thus driving the telescopic beams 3 fast to a new position. The travelled range is calculated with the pulse detector 90, and as the control system detects the approaching target area, i.e. the next locking points in the telescopic beams are detected to approach the locking unit of the frame, the control logic of the control system decelerates the speed of the telescopic beams before the driving ramp 812 of the next locking point 81. At this stage, a rope force of approx. 2 kN has to be generated to the rope system for overriding the resistance to motion caused by the driving ramp 812. As the movement of the telescopic beams continues, the locking roller 822 causes the torque of the motor 70 to change to opposite upon arriving to the form-locking groove 811, which is seen as a change in the current measurement. The logic C drives the torque of the motor to zero. The locking rollers 822 are then at the right place in the form-locking grooves 811 of the locking points 81 of the parts.

The locking springs 823 of the locking unit 82 are chosen so that the locking force compressing the locking rollers 822 to the form-locking groove 811 is sufficient to keep the telescopic beams 3 at place in relation to the frame 2, irrespective of the operation of the twistlocks 6. Typically, the locking force is such that a rope force of approx. 10 kN has to be directed to the lever system before the locking roller 822 rises away from the form-locking groove 811. The operation of the twistlocks again requires a rope force of about 3.5–6 kN. On the other hand, forces larger than a certain limit caused, for example, by an external impact in the axial direction, i.e. in the direction of the longitudinal axis of the telescopic beams, pass through the locking between the locking unit and the locking point in a desired size. The impact energy adheres to the ropes 415 as elastic strain, which is sufficient to return the locking rollers 822 to their initial position in relation to the locking point 81, due to the good efficiency of the whole system.

When required, the program of the logic C detects the deviation with the help of the pulse detector 90 and returns the telescopic beams back to their initial position. With the help of the control logic of the control system and the frequency converter, it is further possible to continuously observe the status of the ropes in the multi-rope system, and to calculate and report the deviations on the basis of the detected rope forces and the target values Fref of the rope forces, so that the preventative maintenance of the lever system becomes considerably simple. By changing the compression force of the locking spring 823 and/or the angles of inclination of the form-locking groove 811 of the locking point the relation of the locking forces compared with the rope force required for operating the rope leverages 42 of the lever system may be modified.

The placement of the ropes 415 (see FIG. 2) in relation to the telescopic beams 3; 3*a*, 3*b* has the consequence that the telescopic beams in question act as counter weights for each other, as the frame 2 of the spreader is in an inclined position in the longitudinal direction and the telescopic beams 3; 3*a*, 3*b* have a differing height position in relation to each other.

The spring force of the springs 52 having a lifting effect on the support rollers 51 of the movement support 5 is such that the springs annul the load caused by the telescopic beams 3 and pressing the support rollers downwards. As the lifting of a container is initiated, the support rollers 51 are pressed downwards as the support of the telescopic beam is mainly transferred to the support 2' of the frame. The wearing sliding surfaces of the frame are thus avoided.

Respectively, when driving the telescopic beams 3 outwards (driving mode B), the brake 72 of the actuator is opened, and the locking rollers 822 are released from the form-locking grooves 811. The ropes 415*b*, 415*c* of the rope pulleys 42 performing the telescopic movement of the telescopic beams rotate to the rope drums 411' and 411", and the ropes 415*a*, 415*d* are released from the said rope drums. The ropes 415*b*, 415*c* affect the points 418*a* and 418*b* of the telescopic beams 3; 3*a*, 3*b*.

When in the driving mode C, one wishes to have the twistlocks 6; 6*a*, 6*b*, 6*c* and 6*d* open, the brake 72 of the actuator is opened and the ropes 415*a* and 415*d* are tightened with the motor 70 so much that the compression springs 420 affecting the twistlocks are stressed more. The travel stops 426 restrict the said movement together with the proximity switches. The locking rollers 822 provide a counter force to the rope force originating from the ropes 415*a* and 415*d*, thus keeping the telescopic beams 3; 3*a*, 3*b* in place. As one wishes to close the twistlocks 6 for gripping a container, the brake 72 is opened and the motor 70 is used for decelerating the closing speed of the twistlocks the compression springs 420 cause to the twistlocks 6. The proximity switches stop the closing movement of the twistlocks as the levers 421 lie against the travel stops 426. The movement of the compression springs has thus been relayed to the lever arms 425 operating the twistlocks 6 through the transferring rods 423. In each telescopic beam, the first transferring rod pulls and the second one presses. The lever arms 425 rotate the twistlocks 6 for a constant angle of 90 degrees. If the rope 415*a* or 415*b* breaks, the twistlocks always remain locked. The increased safety includes that there always are at least two compression springs in both telescopic beams.

The above description of the invention is only intended to visualise the basic idea of the invention. However, one skilled in the art may carry out its details with several alternative ways within the scope of the enclosed patent claims.

Thus, as the rope forces present in the multi-rope lever system deviate considerably from each other in the different driving modes, the logic C may detect possible deviations from the normal operation from the current measurement of the frequency converter and to anticipate possible maintenance tasks. For example when rope forces appear as two current values deviating from each other in the measurement indicates that the ropes have stretched differently. Fref is the force, which is programmed into the logic C1 to indicate the forces occurring in normal use. For preventative maintenance, a directive current value may be given to the control logic circuit at different stages of the working cycle. Considerable deviations are reported to the control cabin of the crane.

In the example described above, the rope forces directed to the lever system are determined as directed to the rope drums 411. However, it is quite possible to determine the rope forces also in other parts of the rope pulleys 41 or rope leverages 42 and to control the operation of the lever system on the basis of these rope force values.

The invention claimed is:

1. A spreader system for lifting containers comprising:

a spreader frame;

at least one telescopic beam telescopically movable in said spreader frame;

at least one locking member positioned between said spreader frame and said at least one telescopic beam for stopping the telescopic movement of said at least one telescopic beam in relation to said frame, said locking member including a locking point comprising a drive ramp and a form-locking groove, and a locking part including a locking roller fitting into the form-locking groove and a locking spring locking the locking roller in said form-locking groove the compression force of the locking spring being adjustable, with a magnet;

at least one twistlock in said at least one telescopic beam having a locked and unlocked position;

a joint multi-rope system for performing the telescopic movement of said at least one telescopic beam and also for actuating said at least one twistlock;

at least one actuator operating said joint multi-rope system; and a control system for supervising and controlling the operations of said at least one actuator and said joint multi-rope system.

2. The spreader system according to claim 1, wherein said actuator generates an external force directed to the telescopic beams, said external force being partly neutralized by the elasticity of the multi-rope system and partly neutralized by the interaction between the locking point of the telescopic beams and the locking unit of the frame.

3. A spreader system for lifting containers comprising:

a spreader frame including a locking unit disposed thereon;

at least one telescopic beam telescopically movable in said spreader frame, said beam including at least one locking point disposed thereon, said locking point being engageable with said locking unit of said frame for releasably locking said at least one telescopic beam in relation to said frame;

at least one twistlock in said at least one telescopic beam having a locked and unlocked position;

a joint multi-rope system for performing the telescopic movement of said at least one telescopic beam and also for actuating said at least one twistlock;

at least one actuator operating said joint multi-rope system, said actuator applying a first rope force on said multi-rope system for telescopically moving said beam in said spreader frame, a second rope force on said multi-rope system for moving said locking point of said beam into engagement with said locking unit of said frame, and a third rope force on said multi-rope system for actuating said twistlock when said locking point of said beam is engaged with said locking unit of said frame, said third rope force being greater than said second rope force and said second rope force being greater than said first rope force; and a control system for supervising and controlling the operations of said at least one actuator and said joint multi-rope system.

* * * * *